US006810961B2

(12) United States Patent
Marvel et al.

(10) Patent No.: US 6,810,961 B2
(45) Date of Patent: Nov. 2, 2004

(54) FLUID WELL PUMPING SYSTEM

(76) Inventors: John E. Marvel, 771 E. 800S, Fairmount, IN (US) 46028-9216; Michael A. Porch, 603 W. 38th St., Anderson, IN (US) 46013; G. Ronald Stoughton, 18 Elm Ct., Anderson, IN (US) 46011

( * ) Notice: Subject to any disclaimer, the term of this patent is extended or adjusted under 35 U.S.C. 154(b) by 0 days.

(21) Appl. No.: 10/348,549

(22) Filed: Jan. 21, 2003

(65) Prior Publication Data

US 2003/0136557 A1 Jul. 24, 2003

Related U.S. Application Data

(60) Provisional application No. 60/350,418, filed on Jan. 21, 2002.

(51) Int. Cl.[7] ..... E21B 43/00; F04F 1/08

(52) U.S. Cl. ..... 166/372; 166/107; 417/122

(58) Field of Search ..... 166/105, 107, 166/869, 372; 417/46, 122, 904

(56) References Cited

U.S. PATENT DOCUMENTS

| | | | | |
|---|---|---|---|---|
| 657,917 A | | 9/1900 | Conrader | |
| 1,604,421 A | | 10/1926 | Oliphant | |
| 1,929,674 A | | 10/1933 | Canfield | |
| 2,142,773 A | | 1/1939 | Athey | |
| 2,173,413 A | | 9/1939 | Foster | |
| 2,340,943 A | | 2/1944 | Downs | |
| 2,429,848 A | | 10/1947 | Smith | |
| 2,442,642 A | | 6/1948 | Eckel | |
| 2,807,216 A | | 9/1957 | Bielstein | |
| 2,822,757 A | | 2/1958 | Coberly | |
| 2,843,046 A | | 7/1958 | Knowles | |
| 2,862,448 A | | 12/1958 | Belding | |
| 3,306,216 A | | 2/1967 | Warman | |
| 3,601,191 A | | 8/1971 | McMurry et al. | |
| 3,736,983 A | | 6/1973 | Beard et al. | |
| 3,894,814 A | | 7/1975 | Morgan | |
| 3,991,825 A | | 11/1976 | Morgan | |
| 4,050,854 A | * | 9/1977 | Hereford et al. | 417/121 |
| 4,076,457 A | | 2/1978 | Skinner et al. | |
| 4,439,110 A | | 3/1984 | Massaux | |
| 4,460,048 A | | 7/1984 | Smith et al. | |

(List continued on next page.)

OTHER PUBLICATIONS

"Introduction to Gas Lift," EVI Oil Tools, ©9/97.

"Guard Dog II Oil Lift Systems," Scientific Oilfield Systems, Inc. Date Apr. 27, 1999.

"More Oil–Less Toil •• Much Gas–At Last," Oiltizer, vol. 20, No. 8, Jan. 25, 1997, p. 2.

"Feed and Low Cost New SOS Oil Production Technology", Scientific Oilfield Systems, Inc. Date Apr. 27, 1999.

"More Oil—Less Toil •• Much Gas—At Last," Scientific Oilfield Systems, Inc. Date Apr. 27, 1999.

*Primary Examiner*—David Bagnell
*Assistant Examiner*—Dan Stephenson
(74) *Attorney, Agent, or Firm*—Woodard, Emhardt, Moriarty, McNett & Henry LLP

(57) ABSTRACT

A fluid well pumping system includes at least one stage for removing fluid from a well. The at least one stage includes a product line assembly adapted for positioning in the well casing as a unit. The product line assembly includes a first product tube and first and second gas lines in a passage of the product tube. The at least one stage also include a fluid reservoir adapted for positioning in a well casing as a unit that is attachable to the product line assembly in end-to-end fashion. The fluid reservoir includes a housing defining a chamber for storage of fluid and a float in the chamber. The fluid reservoir also includes a third gas line in fluid communication with the first gas line, a fourth gas line in fluid communication with the second gas line, and a product line in fluid communication with the product tube when assembled.

24 Claims, 14 Drawing Sheets

U.S. PATENT DOCUMENTS 4,537,256 A 8/1985 Beard
4,589,494 A 5/1986 Sakoda
4,653,989 A 3/1987 Mason
5,027,902 A * 7/1991 Dickinson et al. ..... 166/369
5,141,404 A 8/1992 Newcomer et al.
5,161,956 A 11/1992 Fiedler
5,183,391 A 2/1993 Fiedler
6,435,838 B1 8/2002 Marvel et al.

* cited by examiner

FLUID WELL PUMPING SYSTEM

CROSS-REFERENCE TO RELATED APPLICATION

This application claims the benefit of the filing date of Provisional Application No. 60/350,418, filed Jan. 21, 2002, which is incorporated herein by reference in its entirety.

BACKGROUND

Conventional systems are known for removing fluid such as water or oil from wells where there is an abundant supply of fluid. However, in shallow locations or locations with a low production volume, these systems may not be cost justified. For example, in oil formations up to 1000 feet deep or more which only produce a few barrels of oil per day, multiple oil wells are often situated close together. Equipment and maintenance costs are often economically prohibitive in shallow wells.

Furthermore, due to pressure, chemical conditions, and sand and grit in most oil wells the equipment is subject to high breakdown rates and requires frequent maintenance, repair or replacement. Consequently, particularly for a shallow, low production situations, there is a need for inexpensive, low maintenance pumping systems that can be efficiently installed and/or removed if necessary. Prior approaches to this type of pumping system have involved complex piping and pumping systems, hydraulics, controls, sensors and electronics normally lowered into the well. This results in complex installation and high costs for installation, maintenance and replacement.

There remains a need for a simple, efficient, low cost, low maintenance pumping system that can be installed, repaired and/or removed efficiently and inexpensively in a well. The present invention addresses these needs, among others.

DESCRIPTION OF ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Fluid pumping systems according to the present invention provide improved, low cost, efficient and low maintenance pumping systems for obtaining fluid from a below ground source. It is envisioned that the systems will be used for removing water or oil from shallow wells, but the invention has application for raising any fluids as needed. In connection with the embodiments below, raising oil from shallow oil wells will be particularly discussed.

Figure 1:
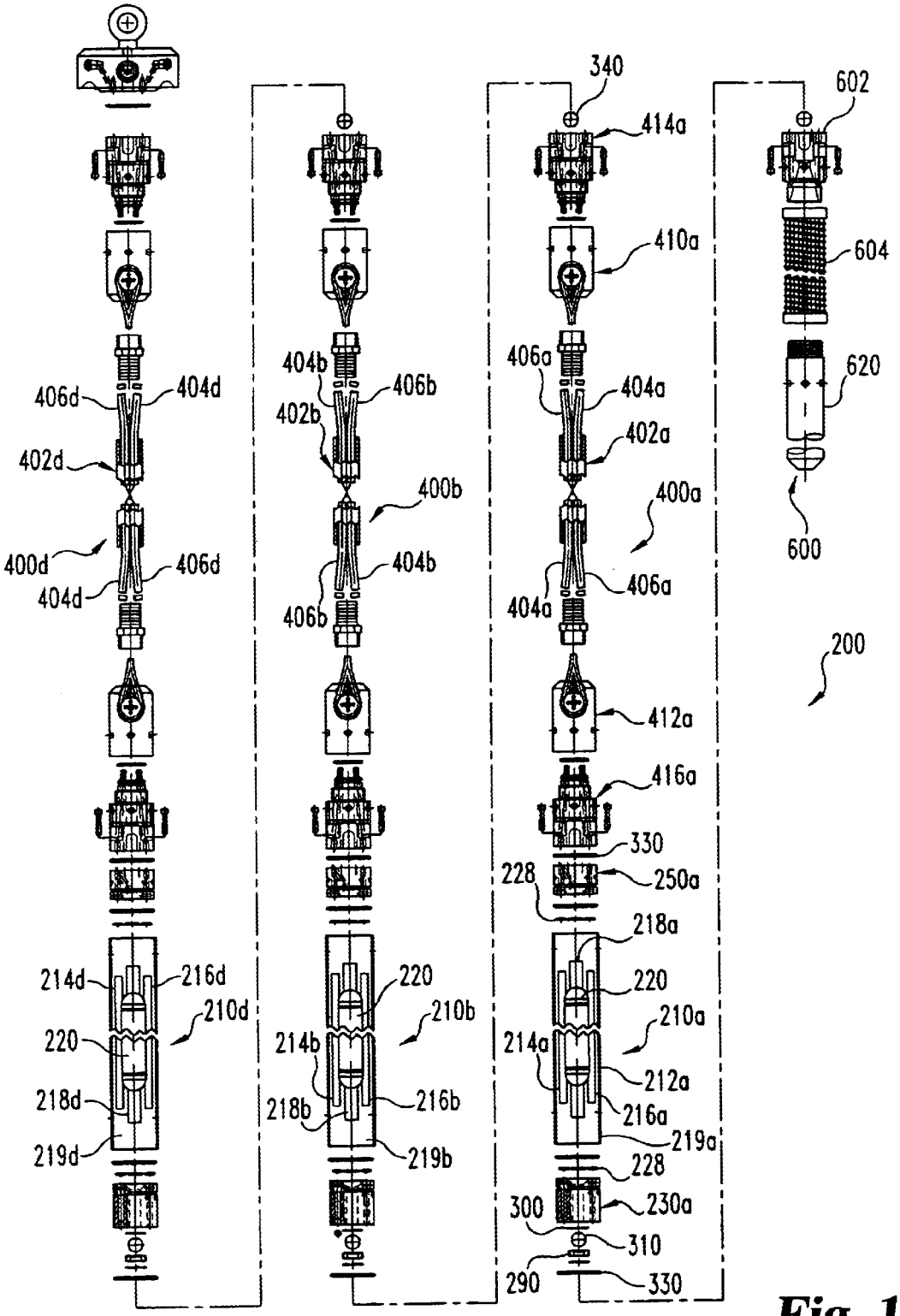
FIG. 1 is an exploded assembly drawing in partial section showing a pumping system according to the present invention.
Figure 2:
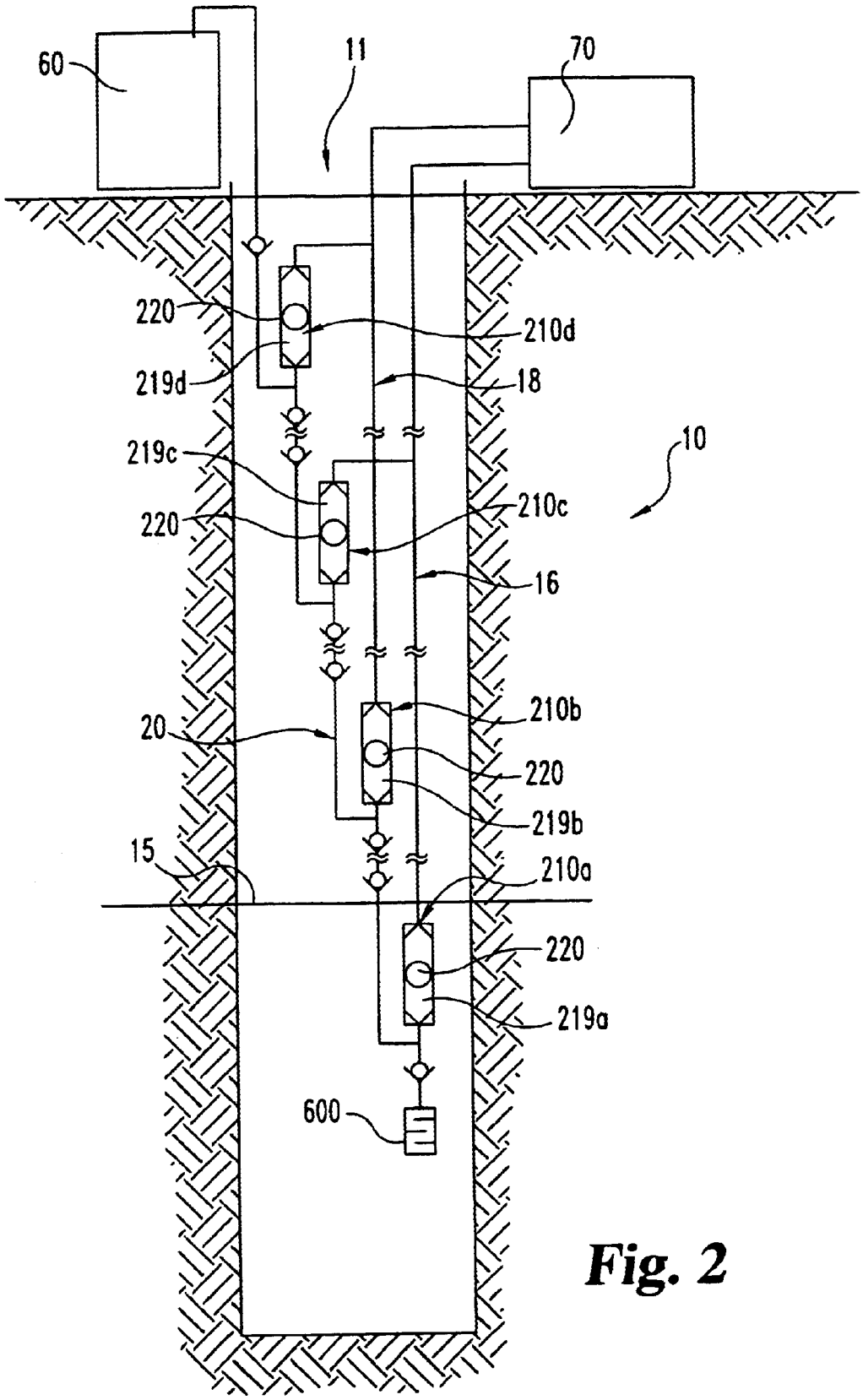
FIG. 2 is a schematic view showing an application of the pumping system of FIG. 1.

Referring now to FIG. 1, there is shown one embodiment of a pumping system 200 according to the invention. Pumping system 200 includes one or more modular stages located below the ground that include a reservoir 200 and a product line assembly 400, each of which are pre-assembled prior to installation in the well. In the illustrated embodiment, pumping system 200 includes bottom reservoir 210*a*, intermediate reservoir 210*b*, and top reservoir 210*d* interconnected with modular product line assemblies 400*a*, 400*b*, 400*d*. It is contemplated that more or less reservoirs 210 and product line assemblies 400 could be provided. The reservoirs 210 and product line assemblies 400 are sized for positioning in a well casing 11 (FIG. 2). Each reservoir 210 includes a storage chamber 219 for receiving fluid and a float 220 that rises and falls with the fluid level in chamber 219. Each reservoir 210 further includes first and second gas lines 214, 216 and a product line 218 therein extending between a top and bottom end of each reservoir.

A wellhead assembly 500 is located at the top of pumping system 200 and is coupled to a fluid supply, such as compressed gas, and to a fluid storage facility. Wellhead assembly 500 is coupled in fluid communication with upper product line assembly 400*d* and receives fluid, such as oil, from the well in which pumping system 200 is placed. A filter assembly 600 is located at the bottom of pumping system 200 and includes an intake for receiving fluid flow, such as oil, from the ground. Filter assembly 600 is coupled in fluid communication with the bottom of bottom reservoir 210*a* to deliver oil thereto.

Bottom product line assembly 400*a* couples bottom reservoir 210*a* in fluid communication with first intermediate reservoir 210*b*. Intermediate product line assembly 400*b* couples first intermediate reservoir 210*b* in fluid communication with top reservoir 210*d*. The product line assemblies 400 include first and second gas supply lines for supplying or exhausting compressed gas to the respective reservoirs 210 and a product line for transferring fluid from a respective reservoir 210 to the adjacent upper reservoir 210 or to wellhead assembly 500. The reservoirs and product line assemblies are adapted and assembled so that a first gas line 404 is in fluid communication with the top of chamber 219 of every other reservoir 210, such reservoirs 210*d* and 210*a* in FIG. 1. Second gas line 406 is in fluid communication with the chamber of the remaining reservoirs 210, such as reservoir 210*b* in FIG. 1. As discussed further below, each reservoir 210 includes a cross-over that provides fluid communication between first gas line 214 and chamber 219. Accordingly, first gas lines 404*d* and 404*a* are in communication with first gas lines 214*d* and 214*a*, respectively, to supply compressed gas to the reservoir chamber 219*d* and 219*a* and pump the fluid stored therein. Second gas line 406*b* is in fluid communication with first gas line 214*b* to supply compressed gas therethrough to reservoir chamber 219*b*. Second gas line 216 for each reservoir extends through reservoir 210 and is isolated from chamber 219.

Accordingly, first gas lines 404*d* and 404*a* are coupled with first gas lines 214*d* and 214*a* of reservoirs 210*d* and 210*a*, respectively, in fluid communication with chambers 219*d* and 219*a*. First gas line 404*b* is coupled with second gas line 216*b* of reservoir 210*b* in isolation from chamber 219*b*. Second gas lines 406*d* and 406*a* are coupled with second gas lines 216*d* and 216*a* of reservoirs 210*d* and 210*a*, respectively, in isolation from chambers 219*d*, 219*a*. Second gas line 406*b* is coupled with first gas line 214*b* of reservoir 210*b* in fluid communication with chamber 219*b*. To facilitate assembly of pumping system 200 in this alternating arrangement, gas lines 404, 406 cross-over in each product tube 402*a*, 402*b*, 402*d* to alternate positions in each product tube assembly 400 so that the orientation of each product tube assembly relative to each reservoir is the same for each assembly. Product lines 218*a*, 218*b*, 218*d* are in fluid communication with respective ones of the product tubes 402*a*, 402*b*, 402*d* to transfer fluid from a reservoir to the adjacent upper reservoir.

Reservoirs 210*a*, 210*b*, 210*d* and product line assemblies 400*a*, 400*b*, 400*d* are each unitized so that pumping assembly 200 can be lowered into the well casing with minimum assembly in the field and also to minimize damage to the components housed by product line assemblies 400 and reservoirs 210 during installation and removal. For example, the gas supply lines and product lines can be enclosed in a product tube 402, such as product tube 402*a* shown in partial section in FIG. 1. Reservoirs 210 each include a reservoir housing 212, such as reservoir housing 212*a* shown in FIG. 1, that is attachable at each end to a product line assembly 400 or to filter assembly 600. The opposite ends of each product line assembly are identical so that either end of product line assembly 400 can be coupled to either of the upper or lower ends of reservoir 210 as pumping assembly 200 is assembled. A keying arrangement is provided at each end of product line assembly 400 and reservoir housing 210 to ensure that the product passages and gas lines are properly aligned before final assembly. Reservoirs 210 and product line assemblies 400 can each be pre-fabricated as units for delivery to the well, and then assembled in the field by attaching product line assemblies 400 in end-to end fashion with the desired number of reservoirs 210 as the system is lowered into the well.

The enclosure of the components and modular attachment mechanisms provided by pumping system 200 improves ease of handling of the system during installation and/or removal, minimizes the risk of damage to the components during installation, operation and removal, and increases the operating life of the system. Thus, pumping system 200 can reduce pumping system downtime and decrease life cycle costs as compared to conventional pump jack systems. Since pumping system 200 need not employ above ground moving parts and can have a low surface profile, it is environmentally friendly.

To install pumping system 200 into well 11 (FIG. 2) filter assembly 600 is coupled to the bottom of bottom reservoir 210*a*. Each product line assemblies 400 can be wound on a reel or the like for delivery to the site. The lower end of product line assembly 400*a* is coupled to the top end of bottom reservoir 210*a*. The partially assembled pumping system is lowered into the well casing with, for example, a cable attached to the lower end of product line assembly 400*a* until the upper end of product line assembly 400*a* is reached. The cable can then be coupled to the upper end of product line assembly 400*a*. The bottom end of first intermediate reservoir 210*b* is coupled to the top end of product line assembly 400*a*. The bottom end of product line assembly 400*b* is coupled to the top end of first intermediate reservoir 210*b*, and the partially assembled pumping system is further lowered into the well casing with a cable attached to the lower end of product line assembly 400*b*. It is also contemplated that the same cable used to lower product line assembly 400*a* into the well can be secured to each of the product line assemblies to facilitate placement into the well casing such that a single cable extends from the bottom of the fluid pumping system to the top.

The product line assemblies, reservoirs, filter assembly and wellhead assembly can be keyed so that the product line assemblies can be attached in the same orientation relative to each reservoir 210. In addition, either of the ends of product line assemblies can be attached to either the upper end of lower end of the reservoirs. The assembly process is repeated until the desired number of reservoirs 210 are positioned in the casing at the desired depth. The last installed product line assembly is then coupled to wellhead assembly 500. The end-to-end assembly and modularity of the system components for pumping system 200 also facilitates removal and replacement of selected components of the stages in the system, further reducing maintenance and life cycle costs.

The fluid pumping system 200 of FIG. 1 has application in a multi-stage pumping system 10 located in a well 11. Although the present invention will work with any desired number of stages or reservoirs, the embodiment of FIG. 2 includes four reservoirs and the embodiment of FIG. 1 includes three reservoirs. Bottom reservoir 210*a* is located so that filter assembly 600 is in or adjacent a fluid source 15. Filter assembly 600 is located in well 11 at the lowest input point of system 10 to receive fluid from fluid source 15. Wellhead assembly 500 is located at the ground level and adapted to direct compressed gas to and exhaust from the gas lines in system 200, and also to direct product flow to storage tank 60. Control unit 70 can include a compressor and control circuitry to alternately supply compressed gas to the first and second gas lines through system 200. Examples of control systems which may be used are provided in U.S. Pat. No. 6,435,838 and which is incorporated herein by reference in its entirety.

Fluid flows from filter assembly 600 into bottom reservoir 210*a*. It is contemplated that about 200–300 feet are provided between reservoirs, and about 200–300 feet between top reservoir 210*d* and storage tank 60. Fluid is moved from bottom reservoir 210*a* to each of the intermediate reservoirs 210*b* and 210*c*, to top reservoir 210*d*, and then into the storage tank or other storage or removal facility with compressed gas supplied to the reservoir chambers. It is also contemplated that one or more of the reservoirs may be bypassed as fluid is moved to the storage tank.

As detailed herein, the present invention will function with as few as a single pumping stage. However, depending on the depth of the well, more pumping stages may be desired. In the schematic of FIG. 2, four such pumping stages are used. When compressed gas is provided to the bottom reservoir 210*a* and upper intermediate reservoir 210*c* via a first gas line 16 in fluid communication with these reservoirs, any fluid in bottom reservoir 210*a* is driven toward lower intermediate reservoir 210*b*, and fluid in the upper intermediate reservoir 210*c* is driven toward top reservoir 210*d* through product tubing 20. Gas from reservoirs 210*b*, 210*d* is exhausted with second gas line 18 as reservoirs 210*b*, 210*d* are filled. Likewise, when compressed gas is provided to the lower intermediate reservoir 210*b* and top reservoir 210*d* via a second gas line 18 that is in fluid communication with these reservoirs, any fluid in top reservoir 210*d* is driven toward storage tank 60 at the surface, and fluid in lower intermediate reservoir 210*b* is driven toward upper intermediate reservoir 210*c* through product tubing 20. Gas from reservoirs 210*a*, 210*c* is exhausted through first gas line 16 as these reservoirs are filled.

Figure 3A:
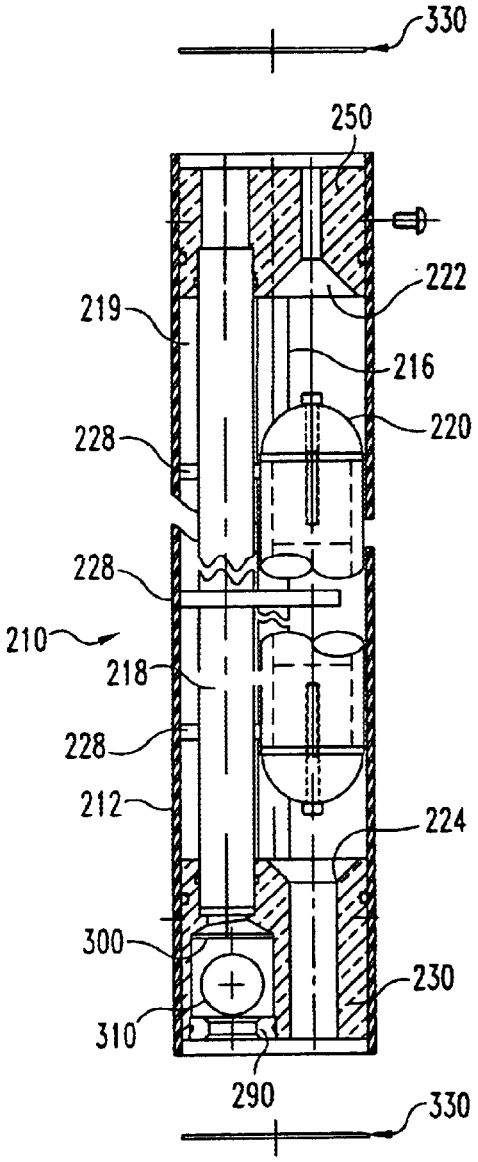
FIGS. 3*a* and 3*b* include a side view and a front view, respectively, in partial section of the fluid reservoir comprising a portion of the pumping system of FIG. 1.
Figure 3B:
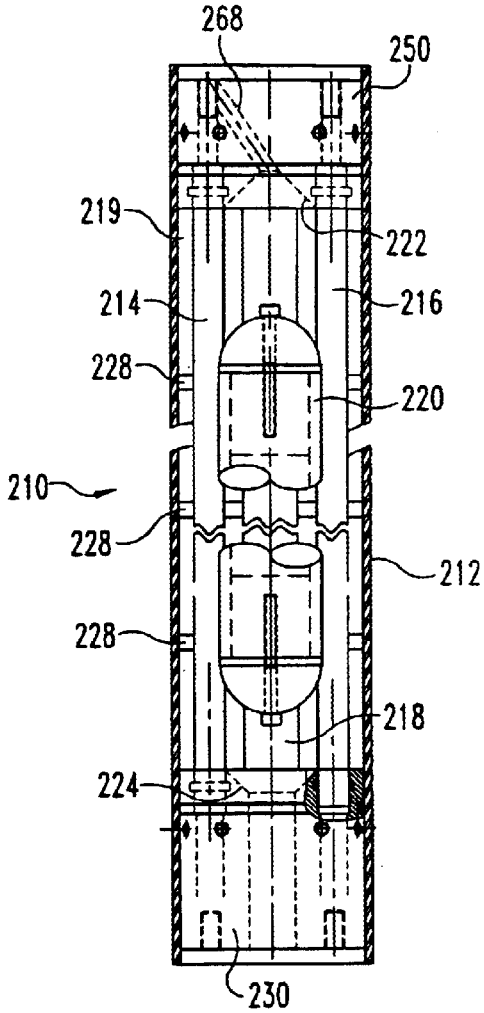

Referring now to FIGS. 3*a* and 3*b*, there is shown a side view and front view, respectively, in partial section of fluid reservoir 210. Reservoir 210 includes a reservoir housing 212 through which first gas line 214, second gas line 216, and product line 218 extend. Bottom reservoir 210*a* (FIG. 2) need not include gas lines 214, 216 although the inclusion of the same makes each reservoir 210 identical. Float 220 is positioned in chamber 219 defined in housing 212 and movable therealong between an upper port 222 and a lower port 224. Gas lines 214, 216 and product line 218 guide float 220 along chamber 219 of housing 212 between upper port 222 and lower port 224. Reservoir 210 further includes a bottom manifold 230, as further shown in FIGS. 5*a*-5*d*, and an upper manifold 250, as further shown in FIGS. 6*a*-6*e*.

Figure 4A:
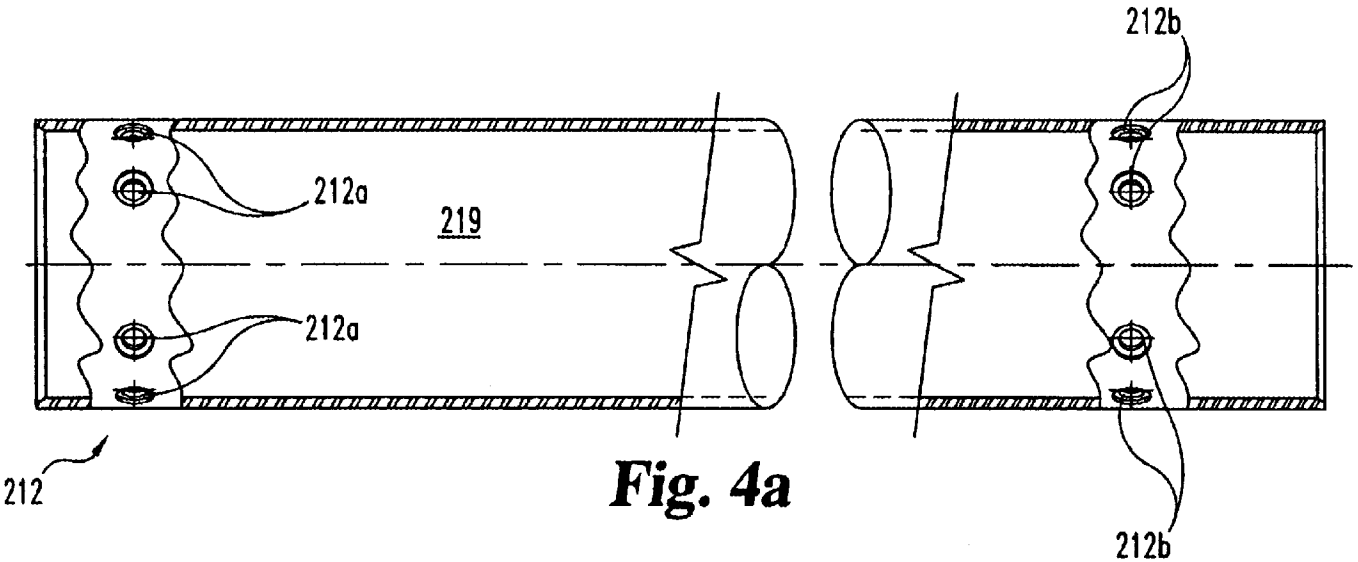
FIG. 4*a* includes a partial section view of the reservoir housing comprising a portion of the reservoir of FIGS. 3*a* and 3*b*.
Figure 4B:
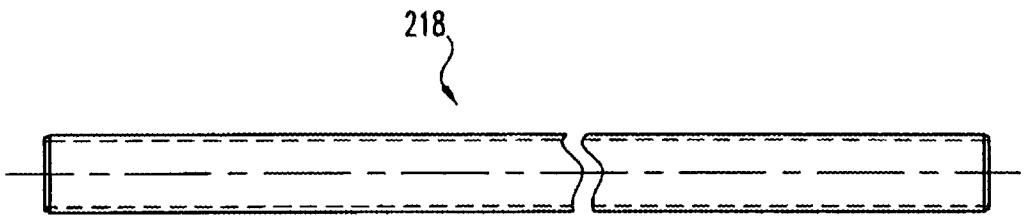
FIGS. 4*b* and 4*c* include partial elevation views of the product line and gas lines, respectively, comprising a portion of the reservoir of FIGS. 3*a* and 3*b*.
Figure 4C:
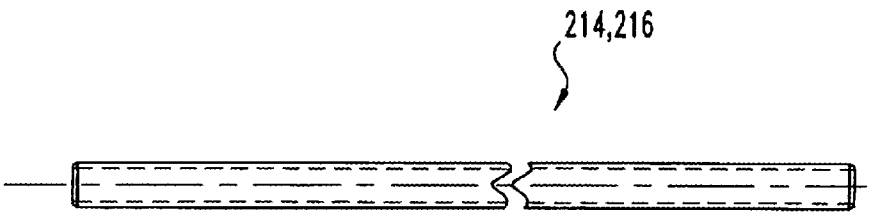
Figure 5A:
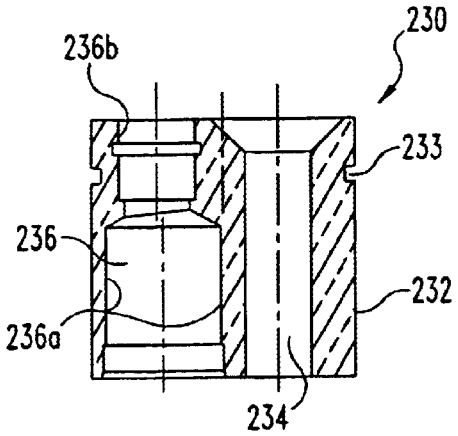
FIGS. 5*a*-5*d* include a side sectional view, front view in partial section, top plan view and bottom plan view, respectively, of a bottom manifold comprising a portion of the reservoir of FIGS. 3*a* and 3*b*.
Figure 5B:
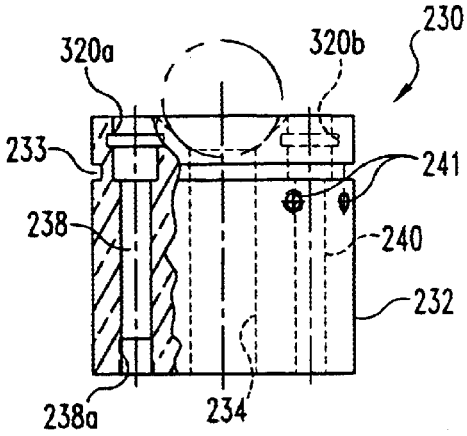
Figure 5C:
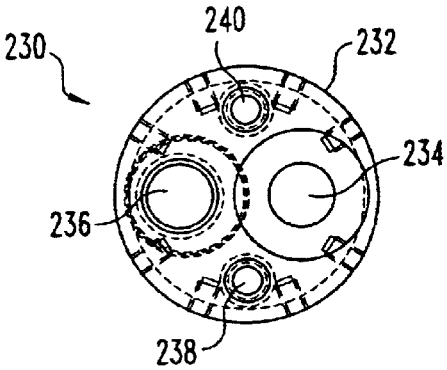
Figure 5D:
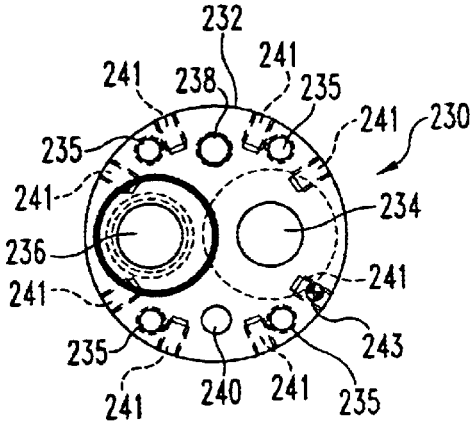
Figure 6A:
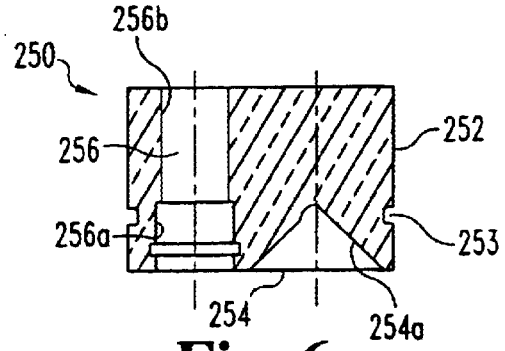
FIGS. 6*a*-6*e* include a side sectional view, front view in partial section, combined top plan and sectional view, and bottom plan view, respectively, of a top manifold comprising a portion of the reservoir of FIGS. 3*a* and 3*b*.
Figure 6B:
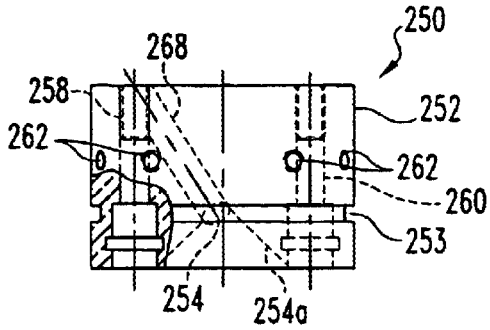
Figure 6C:
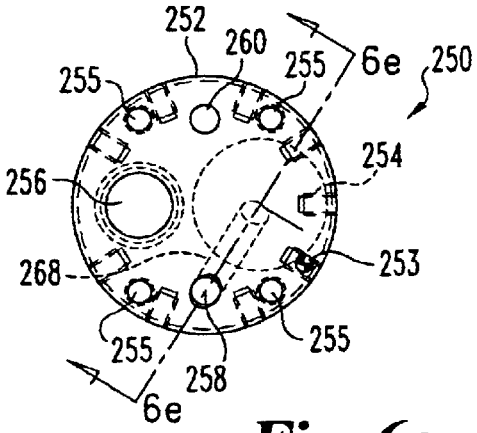
Figure 6E:
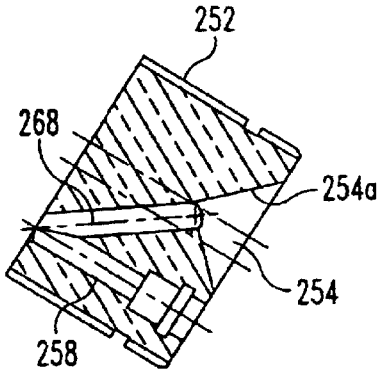
Figure 6D:
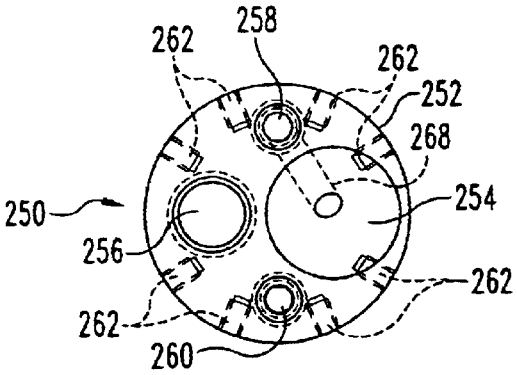
Figure 7F:
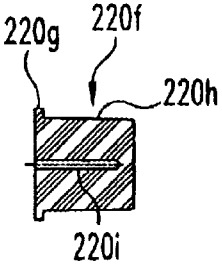
FIGS. 7*e*-7*f* include plan and elevation views of a spacer comprising a portion of the float of FIG. 7*a*.
Figure 7E:
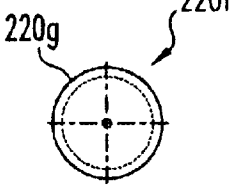
Figure 7D:
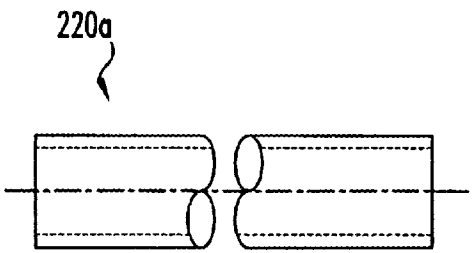
FIG. 7*d* includes an elevation views of a ball comprising a portion of the float of FIG. 7*a*.
Figure 7C:
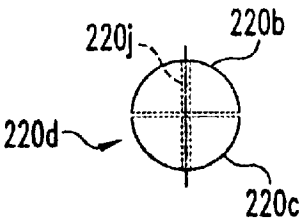
FIGS. 7*b*-7*c* include plan and elevation views of a ball comprising a portion of the float of FIG. 7*a*.
Figure 7B:
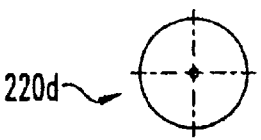
Figure 7A:
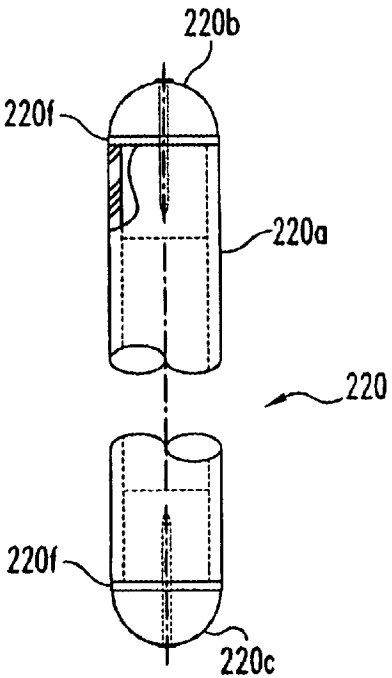
FIG. 7*a* includes an elevation view of a float comprising a portion of the reservoir of FIGS. 3*a* and 3*b*.

As further shown in FIG. 4*a*, housing 212 includes a cylindrical form that defines chamber 219 opening at each end thereof. A number of holes 212*a* can be provided adjacent one end of housing 212 to receive fasteners to secure top manifold 250 in housing 212. A number of holes 212*b* can be provided at the other end of housing 212 to secure bottom manifold 230 to housing 212. Product line 218, as further shown in FIG. 4*b*, can be a cylindrical tube of appropriate diameter to provide product flow therethrough. Gas lines 214, 216, as further shown in FIG. 4*c*, can also be cylindrical tubes of appropriate size to allow passage of the compressed gas, such as compressed air, or other vehicle used to move product from one reservoir to the other. In one particular embodiment, housing 212 has an outside diameter of about 3 inches, product line 218 has an outside diameter of about 0.875 inches and gas lines 214, 216 have outside diameters of 0.5 inches, and are fabricated from stainless steel tubing. Other embodiments contemplate other dimensions and materials, such as plastic material and other metal materials, for housing 212, product line 218 and/or gas lines 214, 216.

Figure 8A:
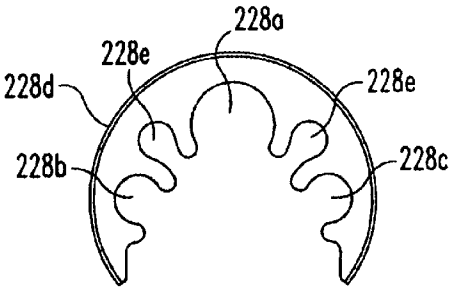
FIGS. 8*a* and 8*b* includes plan and elevation views of a stand-off device for holding the gas lines and product lines in position in the reservoir of FIGS. 3*a* and 3*b*.
Figure 8B:
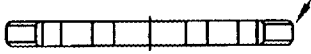

The position of gas lines 214, 216 and product line 218 in reservoir housing 212 can be maintained with three stand-off devices 228, shown in further detail in FIG. 8*a*-8*b*. Stand-off device 228 includes gas line receptacles 228*b*, 228*c* for engaging respective ones of the gas lines 214, 216 and a product line receptacle 228*a* for engaging product line 218. Relieved areas 228*e* can be provided between the receptacles to facilitate flexing of the stand-off device 228 as the product and gas lines are positioned into the receptacles. The outer edge 228*d* of stand-off device 228 abuts against the inner wall surface of housing 212. Other embodiments contemplate employment of fewer than three, or more than three, stand-off devices 228 in housing 212. Stand-off device 228 can be fabricated from rubber material, plastic, metal, or other suitable material. Gas lines 214, 216 and product line 218 can also be sufficiently rigid so that a stand-off device 228 is not required.

Float 220 can sealingly engage upper port 222 when chamber 219 is full of fluid. Float 220 can sealingly engage lower port 224 when chamber 219 is substantially empty of fluid by movement of float 220 downwardly in chamber 219 with compressed gas supplied from the gas line in communication therewith. Non-sealing engagement with upper port 222 and lower port 224 is also contemplated. Furthermore, it is contemplated that float 220 can be fabricated in the same manner as and include the same components as discussed above with respect to the floats discussed in the '838 patent.

Further details regarding one embodiment for float 220 are provided and discussed with reference to FIGS. 7*a*-7*f*. Float 220 includes a hollow cylindrical body 220*a* extending between upper and lower ends 220*b*, 220*c*. Each end 220*b*, 220*c* can be formed from a respective half of spherical ball 220*d*. A spacer 220*f* includes a solid flanged end 220*g* that rests upon the respective end of body 220*a* between body 220*a* and the corresponding end 220*b*, 220*c* when assembled. An extension 220*h* extends from flanged end 220*g*, and a bore 220*i* extends through flanged end 220*g* and into extension 220*h* to receive a fastener. Extension 220*h* is positional positionable within the corresponding open end of body 220*a*. Ball 220*d* is solid and can be severed in half to form the semi-spherical upper and lowers ends 220*b*, 220*c*. A passage 220*j* formed through ball 220*d* can be provided to receive a fastener to secure ends 220*b*, 220*c* to the bore in respective ones of the spacers 220*f* at each end of body 220*a*.

Figure 11A:
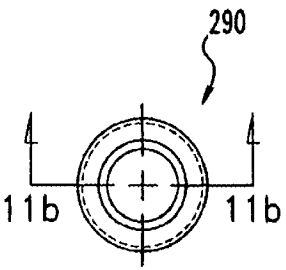
FIG. 11*a* and 11*b* includes plan and sectional views of a valve seat positionable in the product line passage of the bottom manifold coupled to the reservoir of FIGS. 3*a* and 3*b*.
Figure 11B:
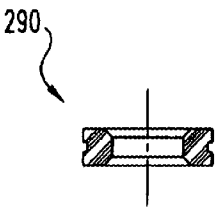
Figure 10A:
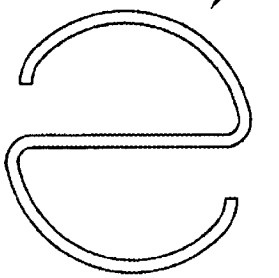
FIG. 10*a* and 10*b* includes side and plan views of a spring clip positionable in the product line passage through the bottom manifold coupled to the reservoir of FIGS. 3*a* and 3*b*.
Figure 10B:
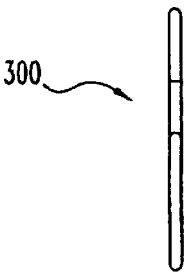

Further details of bottom manifold 230 are provided in FIGS. 5*a*-5*d*. Bottom manifold 230 includes a body 232 engageable to the lower end of reservoir housing 212. A number of openings 241 can be provided to receive fasteners extending through holes 212*b* of reservoir housing 212 to secure bottom manifold 230 thereto. A groove 233 about body 232 receives an O-ring seal to seal manifold 230 in reservoir 210. Bottom manifold 230 includes a reservoir passage 234, a bottom product passage 236, a first bottom gas passage 238, and a second bottom gas passage 240. Bottom product passage 236 has a lower portion 236*a* in which a ball check valve 310 is seatable against float seat 290 (FIGS. 11*a*-11*b*) to prevent reverse fluid flow. Bottom product passage 236 has an upper portion 236*b* into which product line 218 is sealingly positioned. A spring clip wire 300, shown in FIGS. 3*a* and 10, prevents ball check 310 from seating at the interface between lower portion 236*a* and upper portion 236*b*. Gas line passages 238, 240 include upper portions 238*b*, 240*b* that receive gas lines 214, 216, respectively, in sealing engagement. Gas passage 238 of reservoir 210*b* can be provided with a threaded lower portion 238*a* adapted to receive a plug gas passage 238 to bottom reservoir 210*a* since there are no reservoirs below filter assembly 600 that require compressed gas.

Figure 9A:
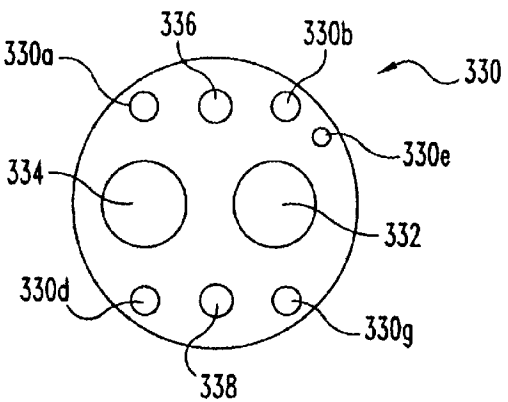
FIG. 9*a* and 9*b* includes plan and elevation views, respectively, of a gasket positionable between a reservoir and the adjacent product line assemblies.
Figure 9B:
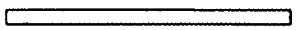

A gasket 330, as shown in FIGS. 3*a* and 9, is positioned in reservoir housing 212 along the bottom surface of bottom manifold 230. Gasket 330 includes openings 332, 334, 336, and 338for bottom reservoir passage 234, bottom product passage 236, and bottom gas passages 240, 238, respectively, to allow passage of fluid and gas flow in the respective passages while providing a sealed interface between the top of product line assembly 400 and the bottom of bottom manifold 230 when product line assembly 400 is coupled to reservoir 210. Gasket 330 further includes openings 330*a*, 330*b*, 330*c*, 330*d* for fasteners that extend therethrough to couple product line assembly 400 to bottom manifold 230 in end-to-end fashion. An opening 330*e* is provided and alignable with dowel pin hole 243 in bottom manifold 230 to receive a dowel pin from product line assembly 400 to ensure proper orientation of product line assembly 400 relative to reservoir 210.

In FIGS. 6*a*-6*d* top manifold 250 is illustrated. Top manifold 250 includes a body 252 engageable to the upper end of reservoir housing 212. A number of openings 262 are provided to receive fasteners that extend through holes 212*a* of reservoir housing 212 to couple top manifold 250 thereto. A groove 253 around body 252 receives an O-ring seal to provide a seal between reservoir 210 and top manifold 250. Top manifold 250 includes an upper reservoir portion 254, a top product passage 256, a first top gas passage 258, and a second top gas passage 260. Top product passage 256 includes a lower portion 256*a* into which product line 218 is sealingly positioned. Top product passage 256 also includes an upper portion 256*b* in fluid communication with product line assembly 400. Reservoir portion 254 includes tapered or flared portion 254*a* against which the upper end of float 220 can be positioned when chamber 219 is full of fluid.

Gas lines 214, 216 are coupled to and extend between bottom manifold 230 and top manifold 250 so that gas can be supplied or exhausted through first top gas passage 258 and second top gas passage 260, respectively, and passed through the respective gas line of the product line assembly 400 coupled thereto. A cross-over 268 extends between upper reservoir portion 254 and first gas passage 258, providing fluid communication therebetween. Cross-over 268 extends from the top surface of top manifold 250 to the apex of upper reservoir portion 254 to deliver gas to move fluid and thereby float 220 down in chamber 219. Gas is delivered to chamber 219 via cross-over 268 from the respective first or second gas lines 404, 406 of product line assembly 400 that is in fluid communication with first upper gas passage 258. When chamber 219 is substantially full, float 220 can seal the opening of cross-over 268 into chamber 219 to prevent product from flowing into the gas lines. When chamber 219 is empty, float 220 can seal the flared opening at the top of reservoir passage 234 of bottom manifold 230 to prevent compressed gas from being delivered therethrough when chamber 219 is empty.

Gasket 330, also shown in FIGS. 3*a* and 9, can also be positioned in reservoir housing 212 and along the upper surface of top manifold 250. Gasket 330 includes openings 334, 336, and 338 for top product passage 256 and top gas passages 258, 260, respectively, to allow passage of fluid and gas flow in the respective passages while providing a sealed interface between the bottom of product line assembly 400 and the top of top manifold 250 when product line assembly 400 is coupled to reservoir 210. For gasket 330 on top manifold 250, opening 332 can be omitted but is provided so that the top and bottom gaskets can be identical to facilitate assembly. Gasket 330 further includes openings 330*a*, 330*b*, 330*c*, 330*d* for fasteners that extend therethrough to couple product line assembly 400 to top manifold 250. Opening 330*e* is provided and alignable with dowel pin hole 263 in top manifold 250 to receive a dowel pin from product line assembly 400 to ensure proper orientation of product line assembly 400 relative to reservoir 210.

Figure 12A:
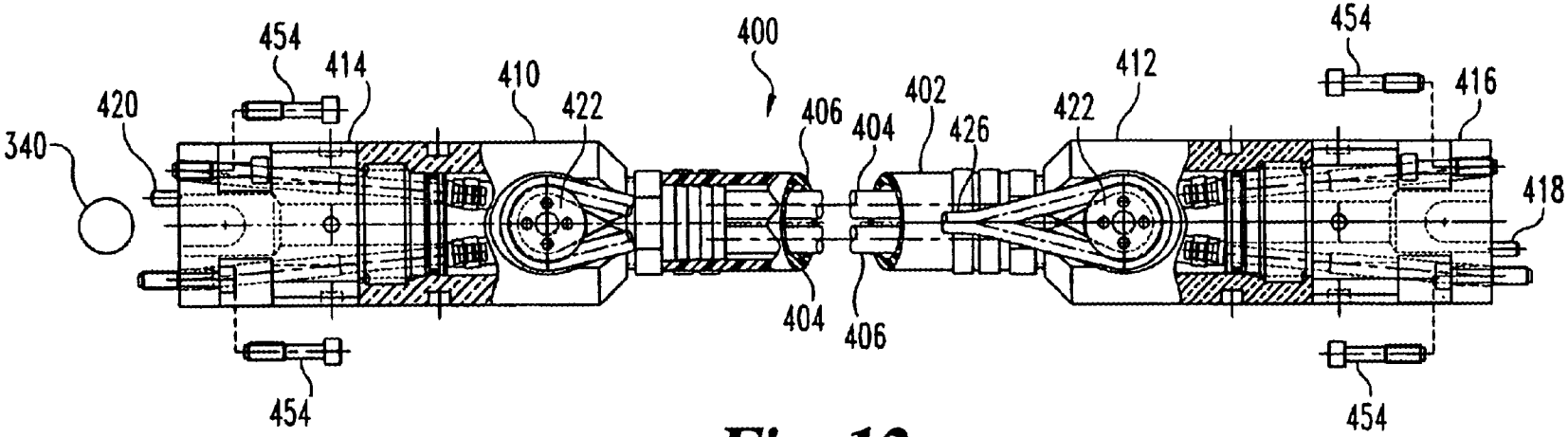
FIGS. 12*a*-12*b* include a front view in partial section and a side view in partial section, respectively, of the product line assembly comprising a portion of the pumping system of FIG. 1.
Figure 12B:
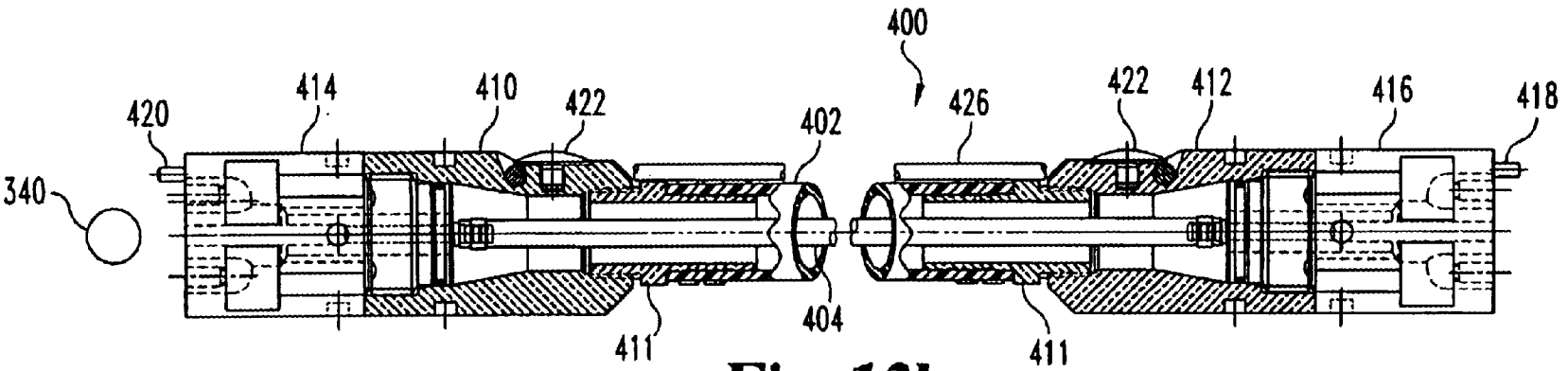
Figure 13B:
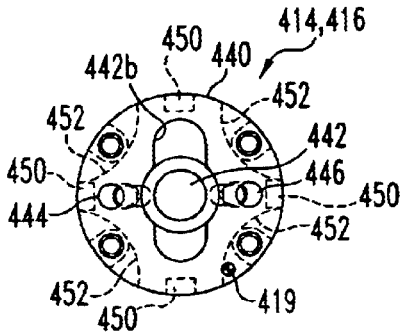
FIGS. 13*a*-13*f* include a front elevation view, a top plan view, a bottom plan view, a side elevation view, and a combined top plan and elevational view, respectively, of an adapter located at the ends of the product line assembly of FIGS. 12*a*-12*c*.
Figure 13A:
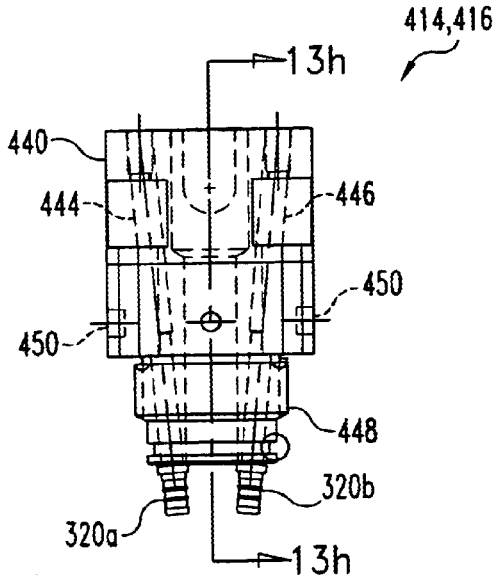
Figure 13D:
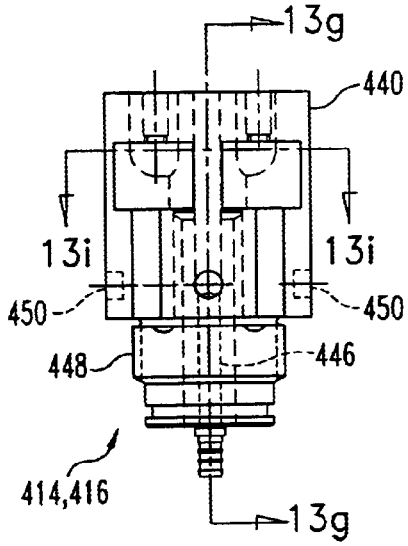
Figure 13C:
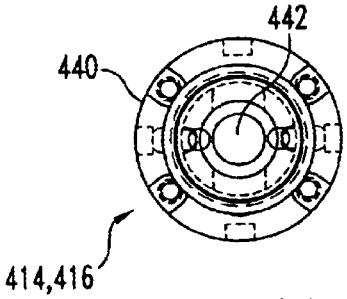
Figure 13G:
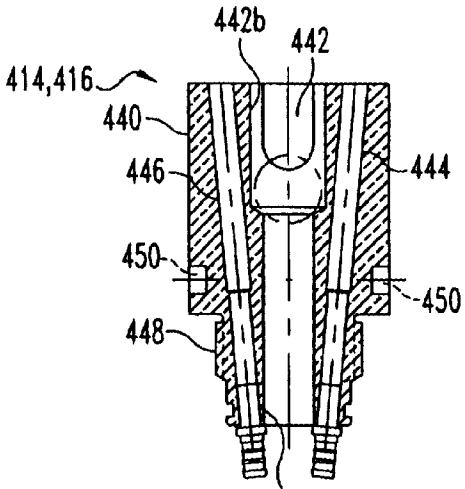
FIGS. 13*g*-13*i* include sectional views through line 13*g*-13*g* of FIG. 13*d*, line 13*h*-13*h* of FIG. 13*a*, and line 13*i*-13*i* of FIG. 13*d*, respectively, of the adapter of FIGS. 13*a*-13*f*.
Figure 13I:
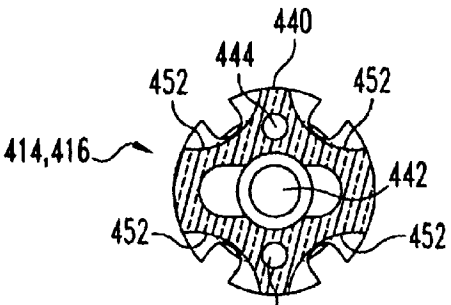
Figure 13H:
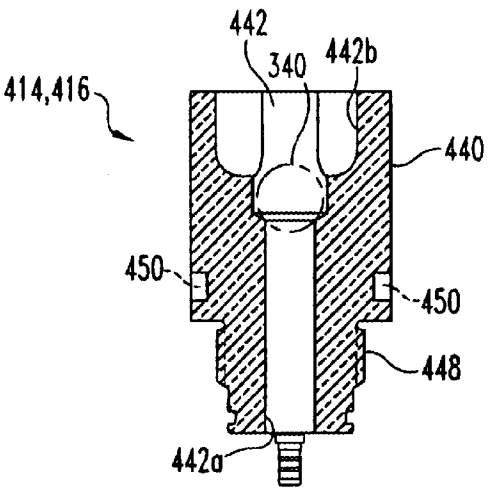
Figure 13E:
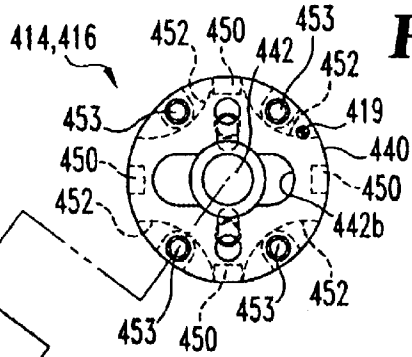
Figure 13F:
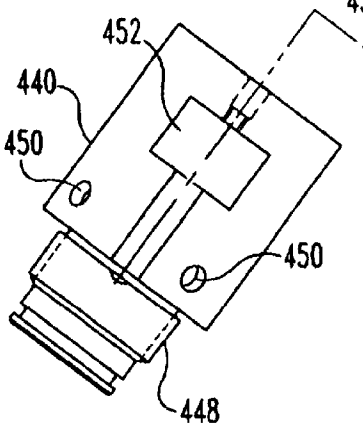

Referring now to FIGS. 12*a*-12*b*, there is shown product line assembly 400 for interconnecting adjacent ones of the reservoirs 210 and also interconnecting the upper reservoir 210*c* to wellhead assembly 500. Product line assembly 400 includes product tube 402 having an inner passage along with first gas line 404 and second gas line 406 extending therethrough. Gas lines 404, 406 cross-over in product tube 402 so that each gas line is in communication with top gas passage 258 and cross-over 268 of only every other one of reservoirs 210. The gas line not in fluid communication with the particular reservoir is coupled to second top gas passage 260 and isolated from the reservoir chamber. As such, compressed gas can be alternately supplied through one of the first and second gas lines 404, 406 to lift the fluid from a lower reservoir to the next adjacent upper reservoir and exhausted through the other of the first and second gas lines 404, 406 as chamber 219 of the adjacent upper reservoir 210 is filled.

Product tube 402 is connected with a coupling member 411 at each of its opposite ends that engage respective ones of an upper housing 410 and a lower housing 412. Upper housing 410 is connected to an upper adapter 414 and lower housing 412 is connected to a lower adapter 416. Upper dowel pin 420 and lower dowel pin 418 are provided and received in dowel pin hole 243 of bottom manifold 230 and dowel pin hole 263 of top manifold 250 to ensure the ends of product line assembly 400 are coupled in the proper orientation relative to the reservoir secured thereto. For example, lower housing 412 and lower adapter 416 can be coupled to the upper end of reservoir 210*a*, and upper housing 410 and upper adapter 414 can be coupled to the lower end of reservoir 210*b*. Upper housing 410 and upper adapter 414 are identical to lower housing 412 and lower adapter 416. As such, product line assembly can be reversed so that upper housing 410 and upper adapter 414 are coupled to the upper end of, for example, reservoir 210*a*, and lower housing 412 and lower adapter 416 are coupled to the lower end of, for example, reservoir 210*b*. This facilitates and minimizes potential error in the field during assembly.

Figure 14B:
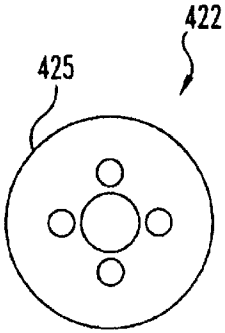
FIG. 14 includes a side view and a plan view of a cable retainer comprising a portion ofthe product line assembly of FIGS. 12*a*-12*c*.
Figure 14A:
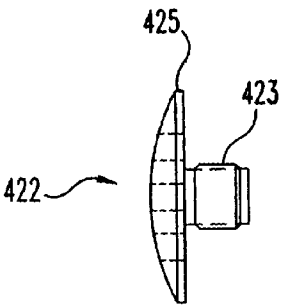

A cable retainer 422, also shown in FIGS. 14*a* and 14*b*, is engaged to an outer surface of each of the housings 410, 412 with a fastener that is integral with or separate from the head 425 of retainer 422. A cable 426 extends between each housing 410, 412 along product tube 402. Cable 426 assists in holding the weight of the lower end of product line assembly 400 and the components attached thereto as it is lowered into the well casing so that the connection between product tube 402 and upper housing 410 need not withstand the entire weight of the assembly. Alternatively, a cable can extend between and be attached to retainers 422 on multiple product line assembliesand extend therefrom to the ground level to assist in lowering the assembly into the well casing.

Figure 15B:
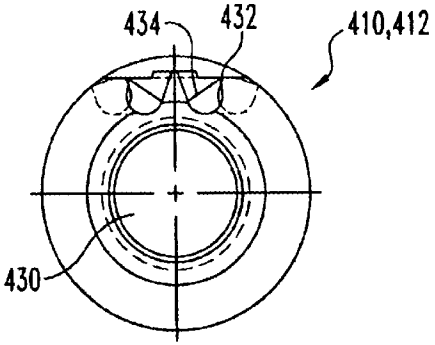
FIGS. 15*a*-15*c* include an elevation view, a bottom plan view, and a sectional view through line 15*c*-15*c* of FIG. 15*b*, respectively, of a housing member comprising a portion of the product line assembly of FIGS. 12*a*-12*c*.
Figure 15C:
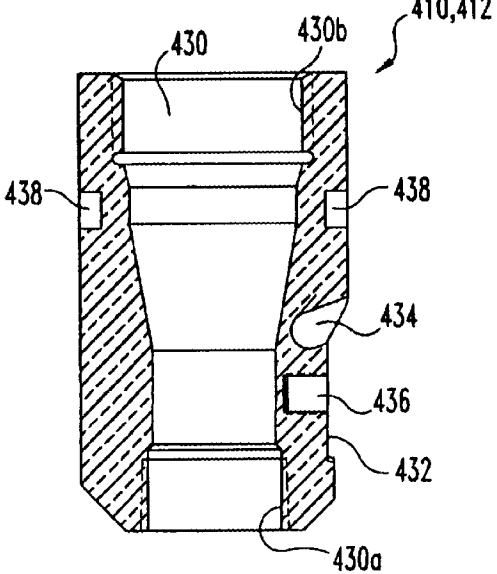
Figure 15A:
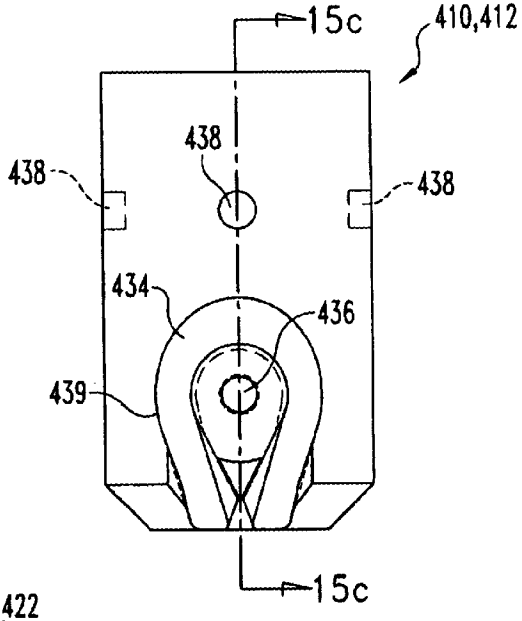

As shown further in FIGS. 15*a*-15*c*, housings 410, 412 are identical and each include a central bore 430 having a tapped portion 430*a* threadingly engaged to the adjacent end of a barb or fitting 411 engaged to the ends of product tube 402. Passage 430 includes a second portion 430*b* into which the respective upper adapter 414 or lower adapter 416 is sealingly positioned. Housings 410, 412 include a recessed portion 432 having a receptacle 434 extending therein into which cable 426 is positioned. Receptacle 434 can have a loop shape, and receive the cable so that it does not protrude from housing 410, 412 and interfere with the well casing as product line assembly 400 is lowered therein. Stud 423 of cable retainer 422 is engaged to a bore 436 in housing 410, 412 to secure the cable in receptacle 434 so that head 425 overlaps cable 426 and secures cable 426 in receptacle 434. Housings 410, 412 further include tool engaging holes 438 spaced therearound that allow a spanner wrench to be engaged thereto to couple product tube 402 to housings 410, 412.

In FIGS. 13*a*-13*h* there are shown further details of adapters 414, 416 that are sealingly engaged to the housings 410, 412. Adapters 414, 416 are identical and include a body 440 having a product line passage 442, a first gas passage 444, and a second gas passage 446 extending therethrough. Fittings 320*a*, 320*b* are located at the ends of passages 444, 446 respectively, for engagement with gas lines 404, 406. Since gas lines 404, 406 cross in product tube 402, fitting 320*a* is engaged to gas line 404 at one end of the product line assembly and to gas line 406 at the other end of the product line assembly. Fitting 320*b* is engaged to gas line 406 at the one end of the product line assembly and to gas line 404 at the other end of the product line assembly. Passages 444, 446 are tapered toward one another through adapter 414, 416 to allow a first end portion 448 of body 440 to be sized to fit within second portion 430*b* of passage 430 of housing 410, 412. First portion 448 can be threaded for engagement with threads in second portion 430*b*. Tool engaging holes 450 are provided around body 440 for engagement with a spanner wrench to facilitate engagement of adapters 414, 416 to housings 410, 412.

Product passage 442 has a first portion 442*a* in fluid communication with product tube 402 to receive fluid flow. Product passage 442 includes a second portion 442*b* flared for fluid communication with bottom product passage 236 of bottom manifold 230 of reservoir 210 or with top product passage 256 of top manifold 250 of reservoir 210. When product line assembly 400 is coupled to bottom manifold 230, second portion 442*b* of product passage 442 of upper adapter 414 is in fluid communication with bottom product passage 236 and reservoir passage 234 of bottom manifold 230. As the fluid and float 220 are lowered in chamber 219 of housing 212 with compressed gas, product from chamber 219 flows from storage in reservoir 212 through reservoir passage 234 into upper adapter 414. A check valve 340 can seat in second portion 442*b* to prevent product from flowing down into product tube 402 and to direct product flow from second portion 442*b* into bottom product passage 236 of bottom manifold 230. Product flow continues from bottom product passage 236 through product line 218, through top manifold 250, and into the product tube 402 of the product tube assembly 400 to the next adjacent reservoir 210. Ball check valve 310 prevents product backflow from product line 218 into the lower product line assembly 400.

For the adapters 414, 416 coupled to top manifold 250 of reservoir 210, top manifold 250 is configured so that second portion 442*b* of product passage 442 is not in communication with chamber 219 of housing 212. Top manifold 250 prevents product from flowing from the flared second portion 442*b* of the lower adapter 416 into upper reservoir portion 254 of top manifold 250. Rather, fluid received from product line 218 flows into top product passage 256, into second portion 442*b* and then into product tube 402. Gas is directed into upper reservoir portion 254 through cross-over 268 as discussed above, which is in fluid communication with a respective one of the gas passages 444, 446 extending through adapter 414, 416. Gas delivered through cross-over 268 drives the fluid and thereby the float 220 down to push product flow out of the bottom reservoir passage 234 and into product line 218 as discussed above.

Recesses 452 are formed laterally in body 440 of adapters 414, 416 and in communication with axially extending bores 453 that open at an end of adapter 414, 416. Recesses 452 and bores 453 are adapted to receive fasteners 454 that extend through bores 453 to couple the adapter 414, 416 to bores 235, 255 of the respective top or bottom manifolds 230, 250 of reservoir 210 in end-to-end fashion. Recesses 452 are formed in body 440 so fasteners 454 do not protrude therefrom and also to provide access for a tool to the heads of the fasteners 454. Recesses 452 allow the size of adapter 414, 416 to be maximized while enabling the assembly of adapter 414, 416 to fit within the well casing and prevent the fasteners from interfering with the well casing. A bore 419 in the end surface of adapters 414, 416 receives a respective one of the dowel pins 418, 420 for engagement therein.

Product tube 402 can be fabricated from suitable material sized to house gas lines 404, 406 and to deliver product flow from the well therethrough. One example contemplates that product tube 402 and gas lines 404, 406 are fabricated from flexible plastic pipe and tubing so that the product tube assembly can be rolled onto a spindle and delivered to the job site.

In FIGS. 16*a*-16*d*, there is further shown filter assembly 600 located at the bottom of the pumping system of FIG. 1. Filter assembly 600 includes a filter adapter 602 and a filter 604. A ballast weight 620 can be coupled to a fitting 607 at the lower end of filter 604 to facilitate placement of the fluid pump assembly in the well casing and provide a counterweight against buoyancy forces that might be encountered. Filter 604 can be any type of filter and/or screen suitable for filtering and/or screening fluid flow from a well.

Figure 16A:
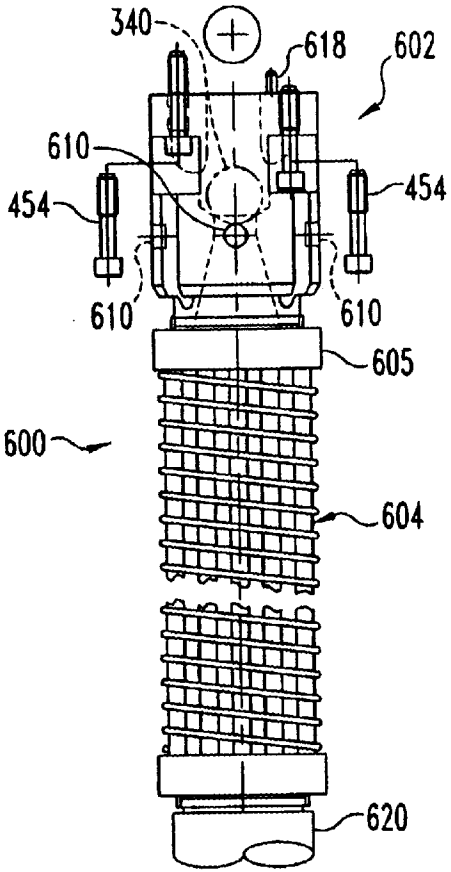
FIG. 16*a* includes an elevational view of the filter assembly located at the bottom of the pumping system of FIG. 1.
Figure 16B:
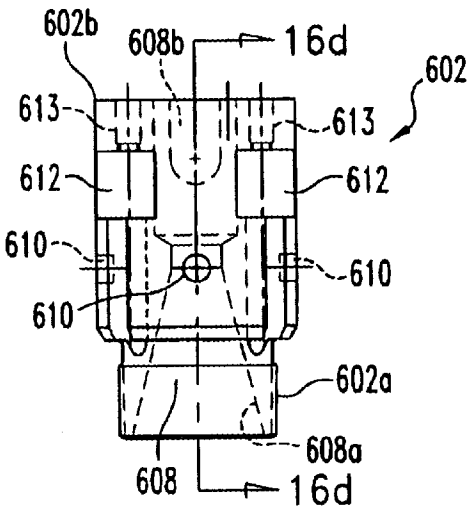
FIGS. 16*b*, 16*c* and 16*d* include an elevational view, a top plan view, and a sectional view through line 16*d*-16*d* of FIG. 16*b* of an adapter comprising a portion of the filter assembly of FIG. 16*a*.
Figure 16C:
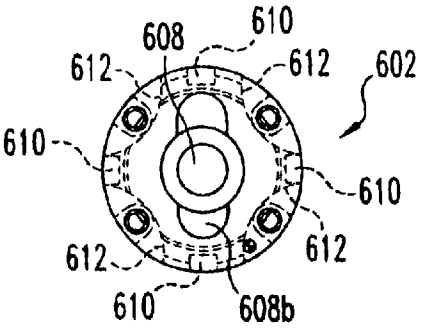
Figure 16D:
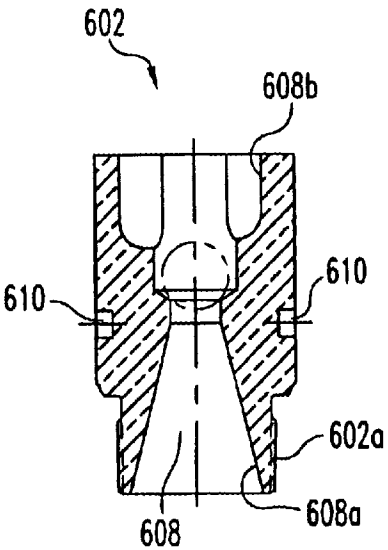

Further details regarding filter adapter 602 are shown in FIGS. 16*b*-16*d*. Filter adapter 602 includes holes 610 to which a spanner wrench can be engaged to facilitate coupling of filter adapter 602 to filter 604. Lower portion 602*a* of adapter 602 can be threaded for engagement with a coupling member 605 at the upper end of filter 604. Filter adapter 602 also includes recesses 612 formed therein adapted to receive fasteners 454 in fastener holes 613 to couple filter adapter 602 to holes 235 of bottom manifold 230 of reservoir 210*a* in end-to-end fashion and seal the gas line passages of bottom manifold 230. Recesses 612 are configured so that fasteners 454 do not protrude from filter adapter 602, allowing the size of filter adapter 602 to be maximized while enabling the adapter 602 to fit within the well casing and prevent the fasteners from interfering with the well casing.

Filter adapter 602 includes a product passage 608. Product passage 608 includes a lower flared portion 608*a* that maximizes the opening size to facilitate product flow from filter 604 into lower reservoir 210*a*. Product passage 608 includes an upper portion 608*b* that is enlarged so that when filter adapter 602 is coupled to the bottom end of reservoir 210*a*, the upper portion 608*b* is in fluid communication with bottom product passage 236 and with bottom reservoir passage 234 of bottom manifold 230 of reservoir 210*a*. As product is moved from the chamber of lower reservoir 210*a*, it flows in upper portion 608*b*, into bottom product passage 236, and up through product line 218 and product tube 402 to the adjacent upper reservoir 210. A ball check valve 340 prevents product from flowing down toward filter 604 as compressed gas is supplied to the lower reservoir 210*a* to raise product to the next adjacent reservoir.

Figure 17C:
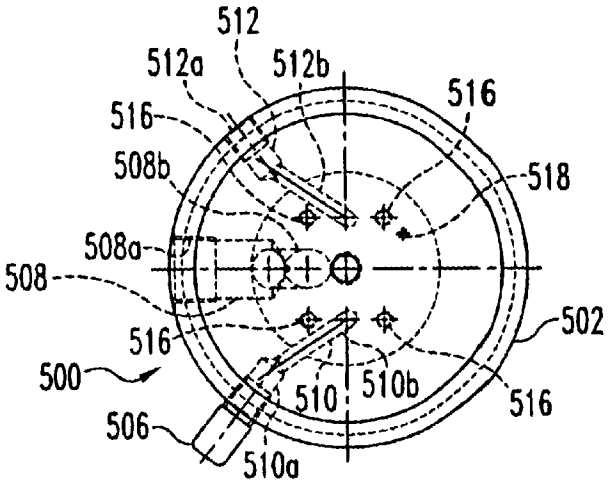
FIGS. 17*a*-17*c* include a front elevation view, a side elevation view and a top plan view, respectively, of a wellhead assembly located at the top of the pumping system of FIG. 1.
Figure 17B:
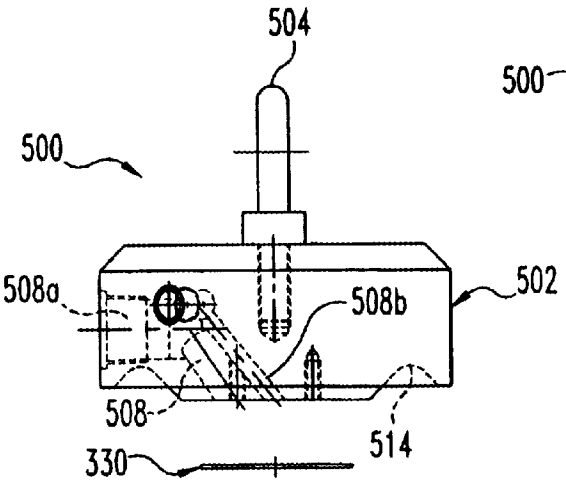
Figure 17A:
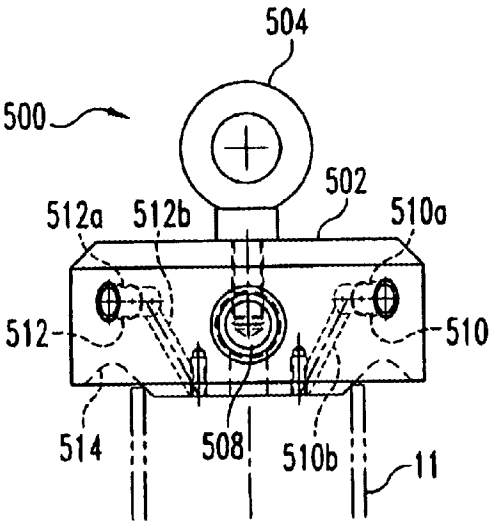

Referring now to FIGS. 17*a*-17*c*, various views of wellhead assembly 500 are provided. Wellhead assembly 500 includes a wellhead 502 and a lifting ring 504. Wellhead 502 includes a product passage 508 extending having an outlet portion 508*a* and an inlet portion 508*b*. Outlet portion 508*a* can be coupled to a product outlet line or other discharge to take fluid product from the well to a storage tank, transport device, or the like. Inlet portion 508*b* is in communication with product passage 442 of the upper adapter 414, 416 of product tube 402*c* to receive fluid flow from product tube 402*c*.

Wellhead 502 also includes gas passages 510, 512 that can be coupled to a gas supply to deliver compressed air, natural gas or other vehicle to operate pumping system 200. The outlet portions 510*a*, 512*a* of gas passages 510, 512 can be threaded or provided with some other configuration suitable for attachment of the source of compressed gas. Second portions 510*b*, 512*b* extend through wellhead 502 and are in communication with the gas lines of product line assembly 400 such that gas passages 510, 512 are in fluid communication with gas passages 444, 446, respectively, of adapter 414, 416 at the top of product line assembly 400*d*. The bottom of wellhead 502 can include a radial groove 514 formed therein to receive the upper end of the well casing 11. A hole 518 is provided to receive dowel pin 420 extending from the upper end of product line assembly 400 to facilitate proper orientation of the well housing 502 thereon so that gas passages 510, 512 are in communication with gas lines 404, 406, respectively, of product line assembly 400. Fastener holes 516 receive fasteners extending from the adapter 414, 416 at the upper end of the upper product line assembly to couple well housing 502 thereto.

The well pump as described herein is designed to reduce cost and maintenance. Additionally, down well sensors can be eliminated completely or minimized. The tubes, lines, housings, pipes, check valves and other equipment be made from readily available parts such as polyethylene tubing, brass, stainless steel, heavy grade PVC tubing or other plastic components. These parts can be moved to the well site without the use of heavy trucks, etc. and assembled without specialized well field equipment. Alternatively, for increased strength or other reasons, the components could be made of metals or other materials suitable for oil well applications or the particular fluid environment in which the pumping system is to be operated.

The above has been described in connection with the pumping of oil, but it is understood that the above system could be used to pump water or other fluids. Additionally, as described herein, any number of stages greater than two can be used. Further, aspects of the invention have application in single reservoir pumping systems. Since it is most readily available, ambient air is preferred for compression and supply through the gas lines; however, natural gas, carbon dioxide, or other gases may also be used.

While the invention has been illustrated and described in detail in the drawings and foregoing description, the same is to be considered as illustrative and not restrictive in character. All changes and modifications that come within the spirit of the invention are desired to be protected.

What is claimed is:

1. A fluid well pumping system, comprising:

a product line assembly adapted for positioning in a well casing as a unit, said product line assembly comprising a first product tube including a passage for moving fluid therethrough, and a first gas line and a second gas line in said passage; and a fluid reservoir adapted for positioning in a well casing as a unit, said fluid reservoir including a reservoir housing defining a chamber for storage of fluid and including a float in said chamber, a top manifold at a top end of said reservoir housing and a bottom manifold at a bottom end of said reservoir housing, said fluid reservoir including a third gas line, a fourth gas line and a product line extending between said top and bottom manifolds, said product line assembly engageable to said top manifold of said reservoir housing with said first gas line in fluid communication with said third gas line, said second gas line in fluid communication with said fourth gas line, and said passage of said product tube in fluid communication with said product line.

2. The system of claim 1, wherein said top manifold includes a body including a first gas passage extending therethrough between said third gas line and said first gas line and a second passage extending between said fourth gas line and said second gas line, said top manifold further including a cross-over passage extending from said first gas passage to provide fluid communication between said chamber and said first gas passage.

3. The system of claim 2, wherein said top manifold includes a tapered upper reservoir portion along an upper end of said chamber to receive said float when said chamber is substantially full of fluid, said cross-over passage opening in said tapered upper reservoir portion and at a top surface of said top manifold.

4. The system of claim 1, further comprising:

a second fluid reservoir adapted for positioning in a well casing as a unit, said second fluid reservoir including a second reservoir housing defining a second chamber for storage of fluid, a top manifold at a top end of said second reservoir housing and a bottom manifold at a bottom end of said second reservoir housing, said second fluid reservoir including a fifth gas line, a sixth gas line and a second product line extending between said top and bottom manifolds, said bottom manifold engageable to a top end of said product line assembly with said fifth gas line in communication with said second gas line of said product line assembly, said sixth gas line in fluid communication with said first gas line of said product line assembly, and said second product line in fluid communication with said product tube of said product line assembly.

5. The system of claim 4, wherein when assembled said first gas line of said product line assembly is in fluid communication with said chamber of said reservoir housing and isolated from said chamber of said second reservoir housing; and said second gas line of said product line assembly is in fluid communication with said chamber of said second reservoir housing and isolated from said chamber of said reservoir housing.

6. The system of claim 4, wherein said product line assembly includes at least at a top end thereof:

a housing coupled to an upper end of said product tube;

an adapter coupled to said housing opposite said product tube, said adapter including a product passage in communication with said passage of said product tube, said product passage of said adapter including an enlarged portion adjacent an top end of said product line assembly to provide fluid communication with each of said chamber of said second fluid reservoir and said second product line of said second fluid reservoir.

7. The system of claim 6, further comprising a check valve in said enlarged portion of said product passage to prevent product flow from said enlarged portion into said product tube of said product line assembly.

8. The system of claim 7, wherein said bottom manifold of said second fluid reservoir comprises a cylindrical body having a bottom product passage between said second product line in said second reservoir housing and said enlarged upper portion of said product passage of said adapter, and further comprising a check valve in said bottom product passage of said bottom manifold to prevent product in said product line from flowing into said enlarged portion of said product passage of said adapter.

9. The system of claim 6, wherein said adapter includes a first gas line passage in fluid communication with said first gas line of said product line assembly and said sixth gas line of said second reservoir and a second gas line passage in fluid communication with said second gas line of said product line assembly and said fifth gas line of said second reservoir.

10. The system of claim 6, wherein said housing of said product line assembly includes a receptacle formed in an outer surface thereof and further comprising a cable secured in said receptacle of said housing, said cable extending along said product tube to a second housing of said product line assembly at a lower end of said product tube, said cable further being secured in a receptacle formed in an outer surface of said second housing.

11. The system of claim 10, wherein said cable is looped at each end thereof and said receptacles each include a loop-shape configured to receive said looped ends of said cable, and further comprising a cable retainer engageable to each of said housings of said product line assembly, said cable retainer including a plate overlapping said cable in said receptacle.

12. The system of claim 6, wherein said adapter includes a number of recesses formed in an outer surface thereof, each of said recesses including an axially extending bore opening at an outer end of said adapter, said recesses adapted to receive a fastener positionable in said bore to secure said adapter to one of said bottom manifold with said fasteners recessed below said outer surface of said adapter.

13. The system of claim 1, further comprising at least one stand-off device in said chamber of said reservoir housing, said stand-off device including an outer surface positionable about an inner wall surface of said housing, said stand-off device further including a first gas line receptacle for receiving said third gas line, a second gas line receptacle for receiving said fourth gas line, and a product line receptacle for receiving said product line, said stand-off device maintaining a position of said third gas line, said fourth gas line and said product line in said chamber.

14. The system of claim 13, wherein said product line, said third gas line and said fourth gas line guide movement of said float in said chamber.

15. The system of claim 1, wherein said product line assembly extends between a first end and a second end, and each of said first and second ends are configured for engagement with said top manifold.

16. A fluid pumping system for a well, comprising:

a fluid reservoir including a reservoir housing defining a chamber for storage of fluid, said fluid reservoir including a first gas line, a second gas line and a product line extending in said chamber of said reservoir housing, said fluid reservoir configured for positioning in the well as a unit; and a product line assembly comprising a first product tube including a passage for receiving fluid stored in said chamber, a third gas line and a fourth gas line in said passage, said product line assembly configured for positioning in the well as a unit, said product line assembly engageable to said reservoir housing in end-to-end fashion with said first gas line in fluid communication with said third gas line, said second gas line in fluid communication with said fourth gas line, and said passage of said product tube in fluid communication with said product line.

17. The system of claim 16, wherein said reservoir housing includes a top manifold at a top end of said reservoir housing, said top manifold being adapted to provide fluid communication between said first and second gas lines of said reservoir housing and said third and fourth gas lines of said product line assembly, respectively, with a bottom end of said product line assembly is engaged to said top end of said reservoir housing.

18. The system of claim 17, wherein said top manifold includes a body including a first gas passage extending therethrough between said first gas line and said third gas line, said top manifold further including a cross-over passage extending from said first gas passage providing fluid communication between said chamber and said first gas passage.

19. The system of claim 18, wherein said top manifold includes a tapered upper reservoir portion along said chamber to receive said float when said chamber is substantially full of fluid, said cross-over passage extending opening at said tapered upper reservoir portion and at said first gas passage.

20. The system of claim 17, further comprising:

a second fluid reservoir including a reservoir housing defining a chamber for storage of fluid, said second fluid reservoir including a fifth gas line in fluid communication with said chamber, a sixth gas line isolated from said chamber, and a second product line extending in said chamber of said reservoir housing, said fluid reservoir configured for positioning in the well as a unit, wherein said second fluid reservoir is engageable to a top end of said product line assembly with said third gas line in fluid communication with said sixth gas line, said fourth gas line in fluid communication with said fifth gas line, and said second product line in fluid communication with said product passage.

21. The system of claim 16, wherein said product line assembly includes an adapter at each end of said product tube, each of said adapters including a number of recesses formed in an outer surface thereof, each of said recesses including a bore extending from an outer end of said adapter to said recess, said recesses adapted to receive a fastener positionable in said bore to secure said adapter to said reservoir housing in end-to-end fashion so that said fasteners are recessed below said outer surface of said adapter.

22. The system of claim 16, wherein a bottom end of said product line assembly is engageable to a top end of said fluid reservoir and further comprising a filter assembly including an adapter at a top end thereof attachable to a bottom end of said fluid reservoir in end-to-end fashion.

23. The system of claim 22, further comprising a wellhead assembly attachable to a top end of said product line assembly, said wellhead assembly including first and second gas line passages to deliver to and receive gas from said third and fourth gas lines of said product line assembly, said wellhead assembly further including a product passage to receive fluid flow from said product tube.

24. The system of claim 16, wherein said product line assembly extends between a first end and a second end, and each of said first and second ends are configured for engagement with either of a top end or a bottom end of said fluid reservoir.

* * * * *